US007152651B2

(12) United States Patent
Fujiwara

(10) Patent No.: US 7,152,651 B2
(45) Date of Patent: Dec. 26, 2006

(54) ADHESIVE TAPE ATTACHING JIG

(75) Inventor: Daisuke Fujiwara, Kanagawa (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/501,251

(22) PCT Filed: Jan. 3, 2003

(86) PCT No.: PCT/US03/00057

§ 371 (c)(1),
(2), (4) Date: Jul. 8, 2004

(87) PCT Pub. No.: WO03/062109

PCT Pub. Date: Jul. 31, 2003

(65) Prior Publication Data

US 2005/0000658 A1 Jan. 6, 2005

(30) Foreign Application Priority Data

Jan. 16, 2002 (JP) ..... 2002-007597

(51) Int. Cl.
*B32B 37/22* (2006.01)

(52) U.S. Cl. ..... 156/574; 156/71; 156/579

(58) Field of Classification Search ..... 156/574, 156/579, 577, 71, 391, 540, 486, 443, 459, 156/475, 523, 543, 581, 582
See application file for complete search history.

(56) References Cited

U.S. PATENT DOCUMENTS 1,901,908 A 3/1933 Hoyos
6,585,023 B1 * 7/2003 Azuhata ..... 156/574
6,748,993 B1 6/2004 Shinozaki et al.

FOREIGN PATENT DOCUMENTS

| | | |
|---|---|---|
| CA | 2324188 | 4/2001 |
| DE | 197 25 184 | 7/1998 |
| EP | 1211136 | 6/2002 |
| JP | 2001-171570 | 6/2001 |

OTHER PUBLICATIONS

Patent Abstracts of Japan, vol. 2000, No. 17, Jun. 5, 2001 & JP 07 242364, Sep. 19, 1995.

* cited by examiner

*Primary Examiner*—Mark A. Osele
(74) *Attorney, Agent, or Firm*—Harold C. Knecht, III

(57) ABSTRACT

An adhesive tape attaching jig (50) that allows adhesive tape, which widens along its length, to be continuously attached to an adherend in a stable and reliable manner. The attaching jig (50) has a construction comprising the combination of a tape holder (11, 12) which receives and holds adhesive tape in the attaching jig, a tape attacher (9) which contact bonds the adhesive tape that has been guided from the tape holder (11, 12) onto the tape attachment surface of an adherend, and a jig guide member (6, 7) which continuously guides the attaching jig (50) along the adherend, wherein the tape holder (11, 12), the tape attacher (9) and the jig guide member (6, 7) each also comprise movable mechanisms (26, 31, 32).

20 Claims, 2 Drawing Sheets

ADHESIVE TAPE ATTACHING JIG

FIELD OF THE INVENTION

The present invention relates to an adhesive tape attaching jig, and more specifically it relates to an adhesive tape attaching jig which allows continuous and stable attachment of adhesive tape to an adherend in a manner conforming thereto, even when the adherend or the adhesive tape has a variable shape.

BACKGROUND OF THE INVENTION

For attachment of adhesive tape to adherends such as automobile sash frames, it has conventionally been common to use an attaching jig for high efficiency attachment operation. This is because effort, time and training are required for manual tape attachment operation to accomplish attachment of adhesive tape onto the prescribed location of an adherend by contact bonding while taking care to avoid wrinkles and air pockets.

Most adhesive tape attaching jigs commonly in use at the current time are constructed with a tape attacher for attachment of adhesive tape to an adherend, a jig guide member for constant maintenance of the distance between and positions of the adherend and the attaching jig, and a tape holder which holds the adhesive tape and feeds it to the tape attacher.

Incidentally, for attachment of adhesive tape to an adherend the attaching jig is mounted at the end of the adherend and attachment of the adhesive tape commences from that position, but it is difficult to situate the jig guide member and tape attacher of the attaching jig in the specified positional relationship conforming to the adherend for each occasion of use. Also, when large curves or bends are present in the adherend it becomes difficult to sustain attachment of the adhesive tape in a continuous manner after the attachment operation has begun. The operations of mounting and removal of the attaching jig during the attachment operation are complicated, and create a greater burden of operation steps. This problem can be solved by using a guide apparatus together with the attaching jig for smoother attachment operation, but this further complicates the attachment operation and requires training for use of the guide apparatus.

In addition, large variation in the tape attachment surface of the adherend also creates problems for use of the attaching jig. Specifically, in cases where the width of the adherend has large variation, uneven contact bonding occurs during the tape attachment, resulting in attachment defects such as air pockets and wrinkles, or even hampering advance of the attaching jig itself.

In cases where the width of the adhesive tape has large variation, since the tape holder of the attaching jig is preset to the tape holding width, the attaching jig must be removed for manual attachment of the wider sections.

SUMMARY OF THE INVENTION

It can be an object of the present invention to provide an attaching jig that allows improved continuous attachment of adhesive tape, for attachment of adhesive tape to an adherend having curved sections or bent sections along its length or an adherend having wide sections along the tape-attachment section. It can also be an object of the present invention to provide such an attaching jig that allows quick, stable and reliable attachment operation regardless of the skill of the operator and requires no manual operation for removal of the attachment jig from the adherend or use of a guide apparatus during the attachment operation.

As a result of diligent research aimed at solving the problems described above, the present inventor has completed the present invention upon obtaining the knowledge that for an adhesive tape attaching jig having a construction with a tape holder, a tape attacher and a jig guide member, it is effective to mount an adjustable or movable mechanism, and preferably a slide mechanism provided with energizing means with a cushioning effect for each of the tape holder, the tape attacher and the jig guide member, to allow shifting of the position of each member to match changes in the shape, size, etc. of the adherend or adhesive tape.

In one aspect of the present invention an adhesive tape attaching jig is provided that is an attaching jig for continuous attachment of adhesive tape in a manner conforming to the shape and/or size of a long adherend. The jig comprises the combination of a tape holder which receives and holds the adhesive tape in the attaching jig, a tape attacher which contact bonds the adhesive tape that has been guided from the tape holder onto the tape attachment surface of the adherend, and a jig guide member which continuously guides the attaching jig along the adherend, wherein the tape holder, the tape attacher and the jig guide member each also comprise adjustable mechanisms.

In the attaching jig of the invention, the adjustable mechanism of the tape holder can exhibit a function of altering the tape receiving or holding width of the tape holder in accordance with changes in the size of the adhesive tape, the adjustable mechanism of the tape attacher can exhibit a function of altering the tape attachment width of the tape attachment head in accordance with changes in the shape and/or size of the adherend, and the adjustable mechanism of the jig guide member can exhibit a function of stably guiding the attaching jig along the adherend in accordance with changes in the shape and/or size of the adherend.

BRIEF DESCRIPTION OF THE DAWINGS

DETAILED DESCRIPTION OF THE INVENTION

Figure 1:
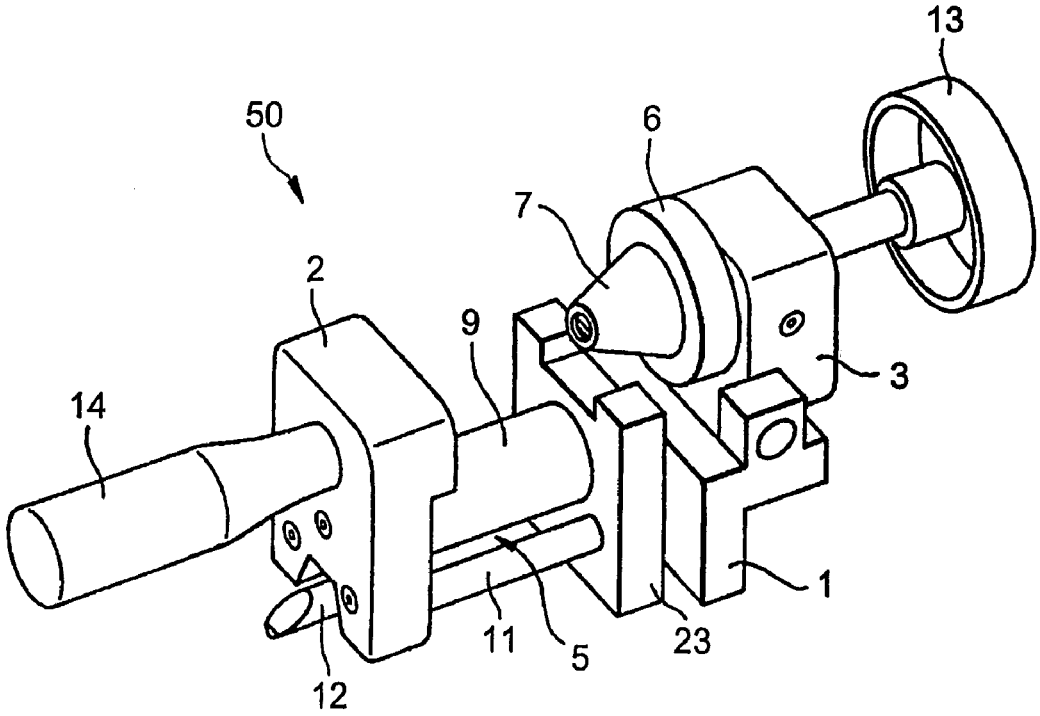
FIG. 1 is a perspective view of a preferred embodiment of an adhesive tape attaching jig according to the invention.

The adhesive tape attaching jig according to the invention possesses at least the constituent members of a tape holder which receives and holds the adhesive tape in the attaching jig, a tape attacher which contact bonds the adhesive tape that has been guided from the tape holder onto the tape attachment surface of the adherend, and a jig guide member which continuously guides the attaching jig along the adherend, in any desired combination. These constituent members are usually supported by support frames or support blocks to enable their combination with each other.

A tape attacher is provided in the attaching jig of the invention in order to press the adhesive tape against the tape attachment surface of the adherend and achieve firm contact bonding. The tape attacher may have any of the various forms commonly employed in the field of attaching jigs, but it is preferably in the form of a tape attachment head. A tape attachment head allows positioning, pressing and reliable contact bonding of the adhesive tape onto the tape attachment site of the adherend. The tape attachment head will usually be used in a fashion mounted on an appropriate support frame.

The tape attachment head may have any of various shapes and sizes and may be formed from various materials. For example, the tape attachment head may be constructed from a cylindrical member or flat member. A cylindrical member is advantageous in that it will provide a construction allowing the head to be rolled over the adherend and thus give an increased contact bonding effect. As one modification of a cylindrical member there may be used a cylindrical member with flat upper and lower sides. The size of the tape attachment head may be varied as desired according to the construction of the attaching jig and the size of each constituent member.

The tape attachment head slides over the tape attachment site of the adherend while successively pressing the adhesive tape onto the tape attachment site, preferably while gradually increasing the pressing force, thus allowing contact bonding of the adhesive tape onto the tape attachment site in the final step to accomplish attachment, and therefore at least a portion of its surface is preferably constructed with a surface layer having the function of an adhesive tape sliding acceleration layer and a cushioning layer. As suitable surface layer materials there may be mentioned elastic materials such as natural and synthetic rubber, foamed plastic materials including polyurethane foam, and various types of felt materials. The surface of the elastic material when used may be covered with a thin skin layer to impart strength. The core material of the tape attachment head may be composed of, for example, a metal material, plastic material or the like. Plastic materials may be advantageously used from the standpoint of lightweightness and workability.

Any number of tape attachment heads may be used for the tape attaching member. One tape attachment head will be sufficient in most cases, but if necessary two or more may be used. When a plurality of tape attachment heads are used, each of the attachment heads may be the same or different from each other. By using a combination of different types of attachment heads it may be possible to obtain greater tape contact bonding effects.

The tape attacher of the adhesive tape attaching jig of the invention is characterized by also having an adjustable mechanism. The adjustable mechanism may have any type of construction, but usually a slide mechanism will be advantageous from the standpoint of the structure of the jig, and providing energizing means offers further advantages. The energizing means may be, for example, a spring or the like. The most advantageous adjustable mechanism for carrying out the invention comprises a shaft and a spring or the like mounted in a manner surrounding it. By mounting such an adjustable mechanism on the tape attacher it is possible to vary the tape attachment width of the tape attachment head as desired to correspond to changes in the shape and/or size of the adherend, while also allowing stable and continuous attachment operation.

The tape attacher may also have a second adjustable mechanism in addition to the adjustable mechanism described above (hereunder referred to as "first adjustable mechanism"). The second adjustable mechanism is for the purpose of appropriately controlling the contact bonding action of the adhesive tape onto the adherend. Specifically, the second adjustable mechanism can appropriately adjust the positional relationship between the tape attacher and the adherend to allow stable and firm contact bonding of the adhesive tape.

The second adjustable mechanism, like the first adjustable mechanism, may be advantageously formed by a slide mechanism provided with energizing means such as a spring, for example. These adjustable mechanisms may be mounted in open spaces such as holes provided at sections of the shaft or block supporting the tape attachment head which do not directly contribute to the action of the jig, as an advantageous mode from the standpoint of conserving space.

The adhesive tape attaching jig of the invention is provided with a tape holder to feed the adhesive tape to the aforementioned tape attacher. Providing a tape holder not only forms a fixed space, usually a slit-shaped tape guide space, between the tape holder and the tape attacher, to facilitate the operation of successively feeding the adhesive tape to the tape attacher, but also stably receives and holds the adhesive tape externally. In fact, when such a tape guide space is present, the adhesive tape can be reliably fed to the tape attacher at a prescribed tension without dangling or veering from the running path.

The tape holder is usually constructed with a plurality of tape holder members necessary to form the tape guide space. The tape holder members are usually mounted with their main sides extending roughly parallel to the running surface of the adhesive tape, either anchored to the support frame of the tape attacher or another support frame, or situated in a rotatable or switchable manner.

The tape holder members may be of any desired shape, size or material so long as no adverse effect is produced on running of the adhesive tape. For example, the shape of the tape holder members may be a thin cylindrical or square cylindrical rod shape, or a long, thin or wide plate shape. If necessary, a tape guide block or the like may also be used to obtain a better tape guide effect. The size of the tape holder members may be varied as desired in accordance with the size of the adhesive tape. The tape holder members may be formed of a metal material, plastic material or the like, but plastic material products are particularly useful.

The tape holder of the adhesive tape attaching jig of the invention is characterized by also having an adjustable mechanism. The adjustable mechanism may have any type of construction, similar to the tape attacher described above. It is usually advantageous for the adjustable mechanism to be a slide mechanism from the standpoint of the structure of the jig, and providing energizing means offers further advantages. The energizing means may be, for example, a spring or the like. The most advantageous adjustable mechanism for carrying out the invention comprises a shaft and a spring or the like mounted in a manner surrounding it. By mounting such an adjustable mechanism on the tape holder it is possible to vary the size of the tape guide space as desired to correspond to changes in the shape or size (width) of the adhesive tape, while also allowing stable feeding and holding of the tape. The adjustable mechanism may also be shared as the first adjustable mechanism of the tape attacher in order to achieve simplification of structure and reduction in manufacturing cost.

The tape holder is also preferably modified in its structure in order to facilitate and stabilize fitting of the adhesive tape onto the attaching jig while also keeping the adhesive tape from veering from the jig during running to ensure stable running. For example, it preferably has a construction wherein the ends of the rod-shaped or plate-shaped tape holder members are free ends, and slit-shaped openings, i.e. adhesive tape fitting holes, are opened therein as well as in the corresponding sections of the tape attacher.

The adhesive tape attaching jig of the invention is also provided with a jig guide member to continuously guide the jig along the adherend. The jig guide member is designed to maintain a constant distance between and constant positions of the adherend and the attaching jig, stabilize the direction of movement of the jig along the contour of the adherend, ensure smooth movement of the jig and achieve proper movement of the tape attacher, and it is therefore placed in contact beforehand with a determined position of the adherend. The jig guide member is preferably capable of clamping the adherend in concert with the tape attacher.

The jig guide member may be modified as desired, but it will usually consist of a jig guide and a support frame or similar member, such as a support block or holder, either anchored thereto or mounted in an adjustable manner. The shape, size and material of the jig guide member are not particularly restricted so long as the expected effects of smooth movement of the jig and proper movement of the tape attacher are achieved. For example, the jig guide may comprise any desired guide member such as a roller or plate. The jig guide is preferably a guide roller. A single guide roller may be provided, or for a more satisfactory guiding effect, two or more different types of guide rollers may be used together. If necessary, such guide rollers may consist of at least two parallel revolving rollers. The size of the jig guide may be altered as desired in balance with the jig as a whole.

The jig guide member will generally be used with its support frame or the like anchored to the jig body, but the recommended manner of use is mounting in an adjustable manner, in order to accomplish smooth fitting operation of the jig on the adherend and to allow the attaching jig to be in contact with the adherend under the appropriate pressing force. For example, the support frame is preferably constructed so as to be foldable by a hinge or the like at its base. In this case, suitable energizing means (for example, a spring) may be used in connection therewith to provide the optimum pressing force.

The jig guide of the jig guide member may be formed into a revolving roller or another appropriate form by molding or the like from such types of slidable materials as metal or plastic, and it is preferably formed into a revolving roller from hard or soft plastic. The revolving roller may have any of various forms within the scope of the invention, and may consist only of a hard or soft plastic material, or alternatively, it may consist of a revolving roller of which at least the surface section is formed of an elastic material. The elastic material may be, for example, natural or synthetic rubber, a foamed plastic material such as polyurethane foam, or a type of felt material.

An additional jig guide (second jig guide) may also be used in combination with the above-mentioned jig guide (hereunder referred to as "first jig guide") of the attaching jig of the invention. The second jig guide supplements the action of the first jig guide for an increased function. Specifically, using the second jig guide helps maintain a constant position of the attach jig with respect to the adherend, clamps the adherend in concert with the first jig guide, and allows the operation of controlling the attitude of the jig to be accomplished more efficiently. The second jig guide may have any shape and size so long as it can clamp the adherend in concert with the first jig guide, but for downsizing of the jig it is preferably constructed in as compact a manner as possible. This second jig guide may have basically the same shape and size as the aforementioned first jig guide. The second jig guide preferably consists of a plastic revolving roller, and either a single one may be used or two or more revolving rollers with the same or different shapes and sizes may be used in combination. When a plurality of revolving rollers are used, the rollers are preferably used in parallel arrangement.

The jig guide member for the adhesive tape attaching jig of the invention is characterized by also having an adjustable mechanism. The adjustable mechanism may have any type of construction, similar to the tape attacher or tape holder described above. It is usually advantageous for the adjustable mechanism to be a slide mechanism from the standpoint of the structure of the jig, and providing energizing means offers further advantages. The energizing means may be, for example, a spring or the like. The most advantageous adjustable mechanism for carrying out the invention comprises a shaft and a spring or the like mounted in a manner surrounding it. By mounting such an adjustable mechanism on the jig guide member it is possible to stably guide the attaching jig along the adherend in accordance with changes in the shape and/or size of the adherend, and thus accomplish a stable tape attaching operation.

As mentioned above, each of the constituent members of the attaching jig of the invention is supported by a support member such as a support frame or support block. Each of the constituent members may be supported by an exclusive support frame etc., or if necessary they may be supported by a common support frame, etc. Two or more support frames, etc. may also be integrally joined using such joining means as a bolt and nut, an adhesive or the like. The size and shape of the support frame, etc. is preferably selected in consideration of the operability and handleability of the jig. Suitable materials for the support frame, etc. include metal materials, for example, iron, aluminum or their alloys, plastic materials, for example, polypropylene resin, polyethylene resin, polyacetal resin, ABS resin, nylon resin, fluorine-containing resins, acrylic resins, and the like. Particularly suitable among these materials are lightweight plastic materials which do not create a load burden even with extended operation. For improved handleability of the attaching jig of the invention it is preferred to also employ a grip as explained below, but the support frame, etc. may also be imparted with a gripping function.

The attaching jig of the invention is also preferably provided with a grip. A grip can facilitate the adhesive tape attaching operation or stretching and compressing of the energizing means. The grip will usually be in the form of a knob or clip, but a plate-shaped plastic member or the like may instead be mounted on the support frame, etc.

For carrying out the invention, the adherend and the adhesive tape to be attached thereto are not particularly restricted, and any ones commonly employed in the technical field may be used, either directly or after undergoing appropriate improvements or modifications. For example, the adherend may be any of a wide variety of objects such as an automobile or other type of vehicle, a building or other type of structure, a machine, a household electric appliance, or the like. However, the function and effect of the attaching jig of the invention are most satisfactorily exhibited when the adherend used is an object with one or more curved, bent or widening sections along its length, or when the adhesive tape used widens along its length. As examples of such adherends with special shapes there may be mentioned automobile door section frames, or so-called door sashes. The adhesive tape comprises any desired base material such as paper, plastic or the like coated with an adhesive layer, for example, a layer of an acrylic-based adhesive, epoxy-based adhesive, urethane-based adhesive, silicone-based adhesive, phenol-based adhesive, vinyl chloride-based adhesive, hot-melt adhesive or the like, with a release layer provided thereover for protection of the adhesive layer. The adhesive tape may be in the form of a roll, sheet, film or the like, and its size may be within a wide range from thin to large widths. If necessary, there may be used adhesive tape which has been pre-cut to the shape of the adherend.

When the attaching jig of the invention is used for attachment of adhesive tape, wrinkles and air pockets do not occur and therefore additional operations such as pressing of the adhesive tape with a squeegee after attachment are not necessary. Even in cases where the shape of the adherend or the width of the adhesive tape has varied during the attachment operation, no attachment defects will occur due to uneven contact bonding, and the attaching jig will not halt. It is also possible to avoid inconveniences such as removal of the jig during the attachment operation or switching to manual attachment operation.

EXAMPLES

Preferred examples of the adhesive tape attaching jig of the invention will now be explained with reference to the attached drawings. It is to be understood, however, that the attaching jig of the invention is not limited to the following examples.

Figure 2:
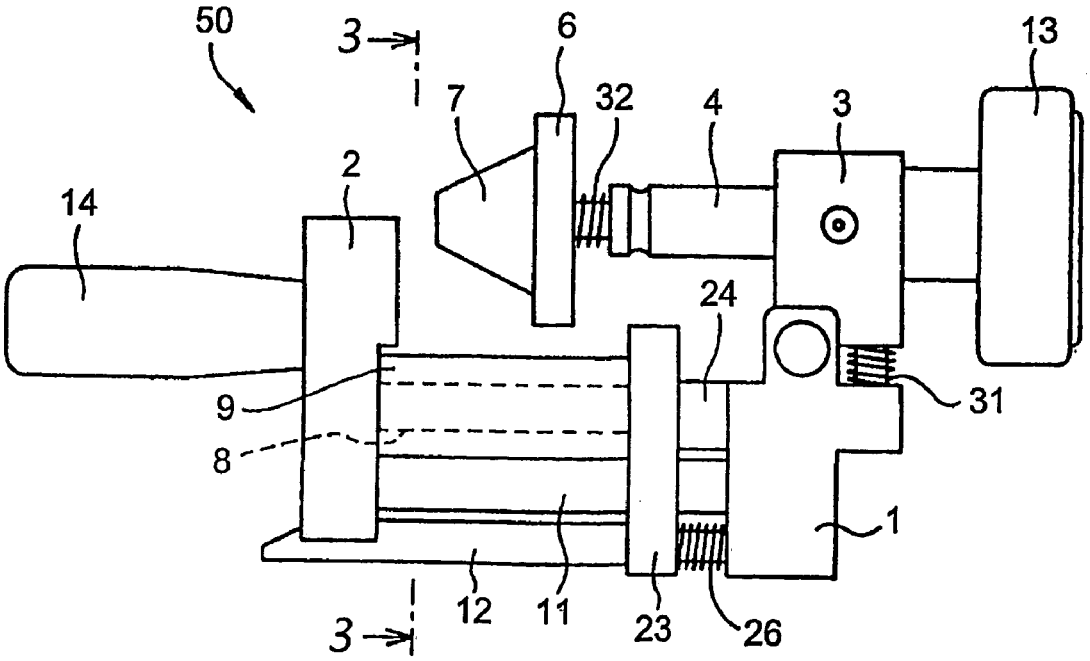
FIG. 2 is a front view of the attaching jig shown in FIG. 1.
Figure 3:
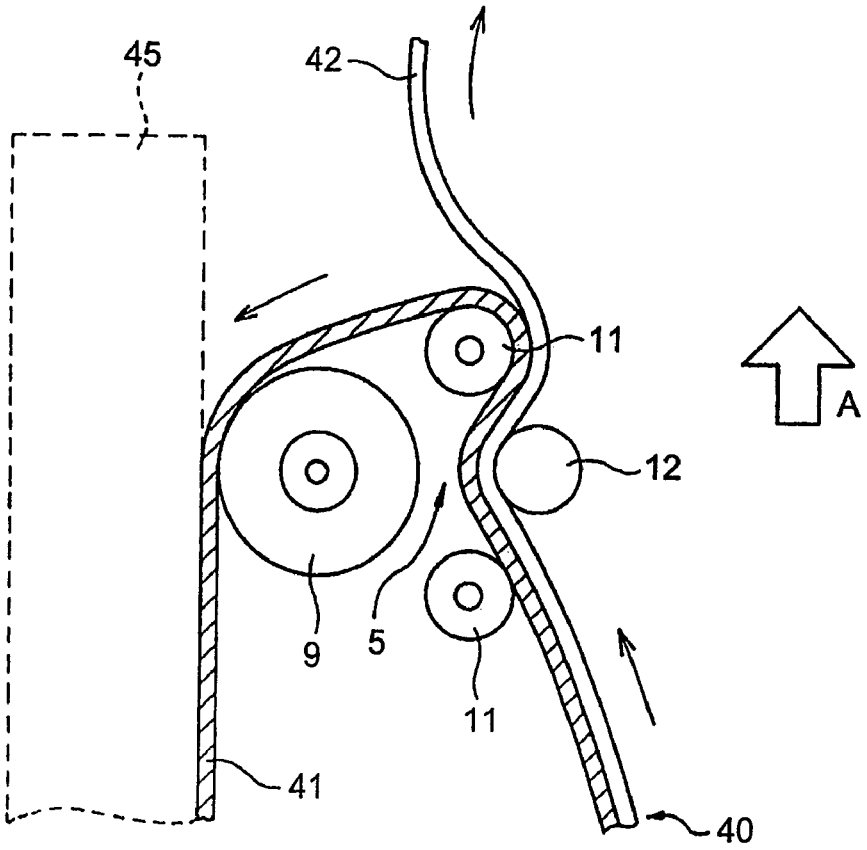
FIG. 3 is a schematic view showing the movement of adhesive tape, in a cross-section along segment III—III of the attaching jig shown in FIG. 2.

FIG. 1 is a perspective view of a preferred embodiment of an adhesive tape attaching jig according to the invention and FIG. 2 is a front view of the attaching jig shown in FIG. 1. Also, FIG. 3 is a cross-sectional view along segment III—III of the attaching jig shown in FIG. 2, for a more simple explanation of the movement of the adhesive tape in the attaching jig of the drawings.

As shown in the drawings, the adhesive tape attaching jig 50 comprises the combination of (1) a tape holder which receives and holds adhesive tape in the attaching jig 50 and is constructed of a tape guide 11, a tape guiding pin 12, etc., (2) a tape attacher which contact bonds the adhesive tape that has been guided from the tape holder onto the tape attachment surface of the adherend and is constructed of an attachment roller 9, etc., and (3) a jig guide member which continuously guides the attaching jig 50 along the adherend and is constructed of guide rollers 6 and 7, etc., in a compact form, each with an adjustable mechanism. The adjustable mechanisms used for this embodiment comprise stainless steel shafts and springs, as will be explained below. The attaching jig 50 is provided with a knob 13 and handle 14 as grips to facilitate manual operation.

The tape holder is constructed with a tape guide 11 and tape guiding pin 12, etc., each made of acetal resin (POM). The tape guide 11 and tape guiding pin 12 are anchored to nylon resin-made support frames 1 and 2 in a manner straddling the frames, and as shown in FIG. 3, the design is such that release sheet-provided adhesive tape 40 moves in the direction of the arrows between the tape guide space 5 formed by the tape guide 11 and the tape guiding pin 12 while the attaching jig moves over the tape attachment surface of the adherend 45 in the direction of the arrow A. The release sheet-provided adhesive tape 40 is separated into the adhesive tape 41 and release sheet 42 before contacting with the adherend 45, and the adhesive tape 41 is then contact bonded with the adherend 45 by the attachment roller 9.

The tape holder also utilizes a support frame 2 and acetal resin-made tape guide block 23 in order to establish the tape guide space 5. The tape guide block 23 is mounted on both the tape guide 11 and guide shaft 24 in a slidable fashion, thus allowing proper adjustment of the width of the tape guide space 5 to match the width of the adhesive tape, against the action of a spring 26 functioning as energizing means, mounted on the tape guiding pin 12. As will be explained below, the tape guide block 23 has the function of allowing proper adjustment of the width of the attachment roller 9 to match the width of the adhesive tape or adherend.

The tape attacher is constructed principally of an attachment roller 9 anchored to the support frames 1 and 2. The attachment roller 9 is cylindrical, and it surface is covered with elastic rubber to allow smooth attachment operation. One end of the attachment roller 9 contacts with the support frame 2, while the other end is mounted in a slidable manner on the guide shaft 24 and contacts with the tape guide block 23. The tape guide block 23 is adjustable to match the width of the adhesive tape or adherend, and therefore stable attachment operation can be carried out in accordance with changes in their shape.

The jig guide member is constructed of guide rollers 6 and 7 mounted on a nylon resin-made guide holder 3 via a stainless steel-made guide shaft 4. The guide shaft 4 is adjustable in the forward and backward directions, and a guide groove and stop groove are carved around the guide shaft 4 to allow it to be stopped at the desired position. The section of the guide rollers 6 and 7 of the guide holder 3 are adjustable up and down by a spring 31, and a knob 13 is utilized to accomplish the adjustment. Since the section of the guide rollers 6 and 7 are adjustable up and down, mounting of the attaching jig onto the adherend is facilitated. The knob 13 can also be utilized for frontward and backward adjustment of the guide shaft 4. While the section of the guide rollers 6 and 7 is adjustable up and down by the spring 31 in the embodiment shown in the drawings, the spring 31 may be eliminated to allow a simple bending movement.

Since the guide rollers 6 and 7 are also provided with a spring 32 as an energizing mechanism, the guide rollers 6 and 7 may be appropriately adjusted while applying the appropriate pressure to the adherend, in accordance with changes in the shape of the adherend. That is, since the spring 32 is stretchable and compressible to allow desired adjustment of the space between the jig guide member and the tape attacher, the spring 32 may be contracted to widen the space between the jig guide member and the tape attacher, to exhibit its function as the jig guide member.

The operation of attachment of the adhesive tape 41 to the adherend 45 using the attaching jig 50 shown in the drawings may be carried out, for example, in the following manner. The adherend 45 here is a section of an automobile sash frame, which has large curved and widening sections along its length. The adhesive tape 41 is usually referred to as "blackout", and it has a release sheet 42 for protection of the adhesive layer.

First, the adhesive tape 41 is set in the tape holder of the attaching jig 50. This is accomplished by manually threading the adhesive tape 41 with the release sheet 42 between the tape guide 11 and the tape guiding pin 12, as shown in FIG. 3. The tape guide block 23 is pressed out by pressing force at the edge of the adhesive tape 41, forming a tape guide space 5 of an appropriate size to match the width of the adhesive tape 41.

Next, the attachment roller 9 of the tape attacher and the guide rollers 6 and 7 of the jig guide member are situated at prescribed positions, and the attaching jig 50 is set on the adherend 45. The attachment roller 9 of the tape attacher is slid to the tape attachment position with the guide rollers 6 and 7 contacting the adherend 45. Next, the attaching jig 50 is moved in the direction of the arrow A, and the adhesive tape 41 is attached to the tape attachment surface of the adherend 45 while peeling off the release sheet 42 from the adhesive tape 41. In the attaching jig 50, the guide rollers 6 and 7 are pressed against the side of the adherend 45 while the attachment roller 9 is pressed against the tape attachment surface of the adherend 45, thus allowing simultaneous smooth running of the attaching jig 50 and firm contact bonding of the adhesive tape 41. This manner of attachment operation can be carried out in a continuous and stable manner with no trouble whatsoever even when bends or the like are present along the adherend 45 or its tape attachment surface varies considerably.

Figure 4:
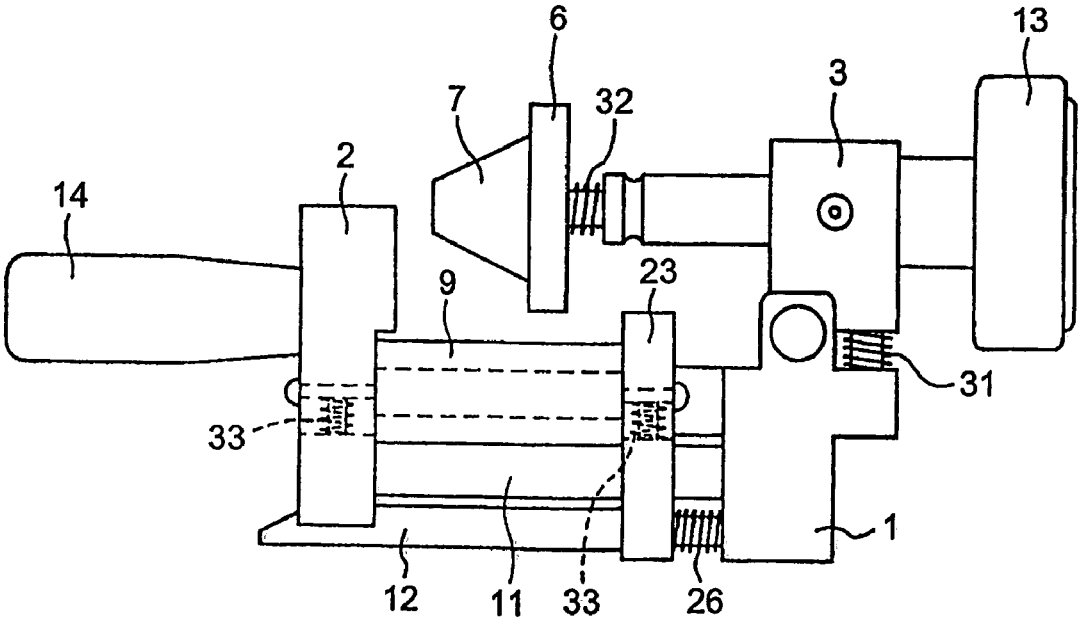
FIG. 4 is a front view of the first embodiment of the attaching jig shown in FIGS. 1 and 2.

FIG. 4 shows an embodiment of the attaching jig 50 shown in FIG. 1 and FIG. 2, with an additional adjustable mechanism. The attachment roller 9 of the tape attacher allows adjustment of the tape guide block 23 through the stretching and compressing action of the spring 26, as mentioned above, thus allowing the tape attachment width to be altered in accordance with the shape and/or size of the adherend for stable attachment operation, but by mounting an additional adjustable mechanism at prescribed locations of the support frame 2 and tape guide block 23, it is possible to press the attachment roller 9 against the adherend with appropriate pressing force to allow a more stable attachment operation, in addition to the function and effect described above. Incidentally, the adjustable mechanism used in the embodiment shown in this drawing comprises a stainless steel shaft and a spring 33 mounted around it.

As explained above, by using an attaching jig according to the present invention it is possible not only to accomplish attachment of various types of adhesive tape to adherends having curved sections or bent sections along their length without providing multiple attaching jigs and using a single common attaching jig, but also to avoid carrying out the complicated operation of removing the attaching jig for manual tape attachment at curved sections and the like, and to enable the attaching jig to run continuously along the adherend, thus allowing attachment of adhesive tape to be accomplished in a quick, easy and stable manner. In addition, these effects are also obtained even when the shape of the adherend or the shape of the adhesive tape includes large variation.

Employing an attaching jig according to the invention also allows easy and reliable attachment of adhesive tape regardless of the skill of the operator, irrespective of the altering angle when the direction (angle) of attachment of the adhesive tape changes as a result of varying shape, and without requiring pasting and peeling.

I claim:

1. An adhesive tape attaching jig which is an attaching jig for continuous attachment of adhesive tape in a manner conforming to the shape and/or size of a long object, said jig comprising:

a tape holder which receives and holds the adhesive tape in said attaching jig;

a tape attacher which contact bonds the adhesive tape that has been guided from said tape holder onto the tape attachment surface of the object; and a jig guide member which continuously guides said attaching jig along the object, wherein said tape holder, said tape attacher and said jig guide member each comprise an adjustable mechanism, said tape attacher adjustable mechanism comprises an adjustable mechanism for matching the width of the adhesive tape, and said jig guide member adjustable mechanism is a separate mechanism from said tape holder adjustable mechanism and said tape attacher adjustable mechanism.

2. An adhesive tape attaching jig according to claim 1, wherein said adjustable mechanism of said tape holder and said adjustable mechanism of said tape attacher are the same mechanism.

3. An adhesive tape attaching jig according to claim 2, wherein said tape attacher also has an adjustable mechanism which allows adjustment of the positional relationship between said tape attacher and the object.

4. An adhesive tape attaching jig according to claim 2, wherein each said adjustable mechanism consists of a slide mechanism provided with energizing means.

5. An adhesive tape attaching jig according to claim 2, wherein said tape attacher has at least one attachment head comprising a cylindrical member.

6. An adhesive tape attaching jig according to claim 2, wherein said attaching jig is suitable for the attachment of adhesive tape in a manner conforming to the shape and/or size of a long object extending in the longitudinal direction and having a varying shape and/or size on the tape attachment surface along its length.

7. An adhesive tape attaching jig according to claim 2, wherein said attaching jig is suitable for attaching an adhesive tape for an automobile sash frame.

8. An adhesive tape attaching jig according to claim 1, wherein said tape attacher also has an adjustable mechanism which allows adjustment of the positional relationship between said tape attacher and the object.

9. An adhesive tape attaching jig according to claim 8, wherein said tape attacher has at least one attachment head comprising a cylindrical member.

10. An adhesive tape attaching jig according to claim 8, wherein said attaching jig is suitable for the attachment of adhesive tape in a manner conforming to the shape and/or size of a long object extending in the longitudinal direction and having a varying shape and/or size on the tape attachment surface along its length.

11. An adhesive tape attaching jig according to claim 1, wherein each said adjustable mechanism consists of a slide mechanism provided with energizing means.

12. An adhesive tape attaching jig according to claim 11, wherein said tape attacher has at least one attachment head comprising a cylindrical member.

13. An adhesive tape attaching jig according to claim 11, wherein said attaching jig is suitable for the attachment of adhesive tape in a manner conforming to the shape and/or size of a long object extending in the longitudinal direction and having a varying shape and/or size on the tape attachment surface along its length.

14. An adhesive tape attaching jig according to claim 1, wherein said tape attacher has at least one attachment head comprising a cylindrical member.

15. An adhesive tape attaching jig according to claim 14, wherein said attaching jig is suitable for the attachment of adhesive tape in a manner conforming to the shape and/or size of a long object extending in the longitudinal direction and having a varying shape and/or size on the tape attachment surface along its length.

16. An adhesive tape attaching jig according to claim 1, wherein said attaching jig is suitable for the attachment of adhesive tape in a manner conforming to the shape and/or size of a long object extending in the longitudinal direction and having a varying shape and/or size on the tape attachment surface along its length.

17. An adhesive tape attaching jig according to claim 1, wherein said attaching jig is suitable for attaching an adhesive tape for an automobile sash frame.

18. An adhesive tape attaching jig according to claim 1, wherein said tape holder comprises an adjustable mechanism for matching the width of the adhesive tape or object.

19. An adhesive tape attaching jig according to claim 1, wherein said jig guide member comprises an adjustable mechanism for adjusting the space between said jig guide member and said tape attacher.

20. An adhesive tape attaching jig according to claim 1, wherein said tape attacher adjustable mechanism comprises a first adjustable mechanism and said tape attacher further comprises a second adjustable mechanism and each of said tape holder adjustable mechanism, said tape attacher second adjustable mechanism, and said jig guide member adjustable mechanism is a separate adjustable mechanism.

* * * * *